US008207956B2

(12) United States Patent
Lin et al.

(10) Patent No.: US 8,207,956 B2
(45) Date of Patent: Jun. 26, 2012

(54) TRANSMISSION SIGNAL GENERATING METHOD AND RELATED APPARATUS FOR A DISPLAY DEVICE

(75) Inventors: Wen-Chi Lin, Yilan County (TW); Che-Li Lin, Taipei (TW); Shao-Chung Ho, Hsinchu (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 1059 days.

(21) Appl. No.: 12/129,706

(22) Filed: May 30, 2008

(65) Prior Publication Data

US 2009/0201277 A1 Aug. 13, 2009

(30) Foreign Application Priority Data

Feb. 13, 2008 (TW) ..... 97105028 A

(51) Int. Cl.
*G09G 5/00* (2006.01)

(52) U.S. Cl. ..... 345/209; 345/94; 345/98

(58) Field of Classification Search ..... 345/94–96, 345/98–100, 103, 208–213
See application file for complete search history.

(56) References Cited

U.S. PATENT DOCUMENTS

2005/0147178 A1* 7/2005 Kikuchi ..... 375/288
2008/0246752 A1* 10/2008 Lee ..... 345/213
2010/0225620 A1* 9/2010 Lee ..... 345/204

* cited by examiner

*Primary Examiner* — Jimmy H Nguyen
(74) *Attorney, Agent, or Firm* — Winston Hsu; Scott Margo

(57) ABSTRACT

The present invention provides a transmission signal generating method for a display device to compensate channel effect. The transmission signal generating method includes using a plurality of signal amplitudes and a first signal direction to generate a plurality of positive levels, using the plurality of signal amplitudes and a second signal direction to generate a plurality of negative levels, and using a plurality of signaling lines for transmission of the pluralities of negative and positive levels. A first positive level and a first negative level both have a minimum signal amplitude of the plurality of signal amplitudes. The amplitude difference of the first positive and negative levels is greater than an amplitude difference of any two neighboring levels of the plurality of negative levels and also the plurality of positive levels.

18 Claims, 18 Drawing Sheets

500

| CDi_D0 | CDi_D1 | S1 | S2 | S3 | S4 | CDi_0N | CDi_0P | CDi_1N | CDi_1P |
|---|---|---|---|---|---|---|---|---|---|
| 0 | 0 | 0 | 0 | 1 | 1 | aI | -aI | -bI | bI |
| 0 | 1 | 0 | 1 | 1 | 0 | -aI | aI | bI | -bI |
| 1 | 0 | 1 | 0 | 0 | 1 | bI | -bI | -aI | aI |
| 1 | 1 | 1 | 1 | 0 | 0 | -bI | bI | aI | -aI |

FIG. 18

TRANSMISSION SIGNAL GENERATING METHOD AND RELATED APPARATUS FOR A DISPLAY DEVICE

BACKGROUND OF THE INVENTION

1. Field of the Invention

The present invention relates to a transmission signal generating method and related device, and more particularly to a method of generating multilevel transmission signals for a display and related device.

2. Description of the Prior Art

A typical driving system of a liquid crystal display (LCD) includes a timing controller, source drivers and gate drivers. Transmission interfaces commonly used for signal transfer between the timing controller and the source drivers are interfaces with two signal levels, such as reduced swing differential signaling (RSDS) and mini low voltage differential signaling (mini-LVDS) interfaces. For the RSDS interface, the transmission signal, as a two-level signal, has properties of single current intensity and two opposite current directions and can generate a voltage signal having properties of single amplitude and two opposite polarities at the receiving side. With market and technological trends of LCDs, resolution and color performances are advanced, requiring an increase in data and clock rates, realized with a multilevel signal transmission interface using multi-intensity and bidirectional signals. The multilevel signal transmission interface allows more data to be transmitted in one clock cycle.

Bus type signaling or a dedicated type signaling architecture can be used in transmission architecture between the timing controller and the source drivers. The former allows multiple source drivers sharing the same signaling lines coupled to the timing controller, whereas the latter utilizes an independent signaling line pair for each source driver. Please refer to FIGS. 1 and 2, which are respectively schematic diagrams of driving systems 10 and 20 both adopting the dedicated type signaling architecture according to the prior art. In the driving system 10, a timing controller TCON includes a differential signal generator TXi coupled to a source driver CDi via a signaling line pair CDi_P/N including signaling lines CDi_0P, CDi_0N, CDi_1P and CDi_1N, where i is 1-10, and 10 is an amount of source drivers. Outside the source driver CDi, a terminal circuit T is placed between signaling lines CDi_0P and CDi_0N and between signaling lines CDi_1P and CDi_1N as well. The driving system 10 provides a common voltage CDi_VCOM for the terminal circuit T commonly consisting of two cascaded resistors. The timing controller TCON generates multiple-level differential signals sent on the signaling line pair CDi_P/N for the source driver CDi, and thereby the differential signals can generate multiple-level voltage signals with two possible polarities. According to the voltage signals, the source driver CDi can determine types and logic states for the voltage signals for transmission data decoding. As for the driving system 20, the terminal circuit T is installed in the source driver CDi and provided with the common voltage CDi_VCOM. The same operating principle is used in both of the driving systems 10 and 20.

Please refer to FIGS. 3 and 4, which are respectively schematic diagrams of driving systems 30 and 40 according to the prior art. Obviously, the driving systems 30 and 40 have almost the same architecture as the driving systems 10 and 20, respectively. The difference is that the driving systems 30 and 40 both remove the common voltage CDi_VCOM from the terminal circuits T.

In the driving systems 10-40, the transmission signal of the signaling line pair CDi_P/N consists of two signal pairs which each can be transmitted by any two of the signaling lines CDi_0P, CDi_0N, CDi_1P and CDi_1N. For example, the signaling lines CDi_0P and CDi_0N transmit one signal pair, whereas the signaling lines CDi_1P and CDi_1N transmit the other signal pair. Please refer to FIGS. 5 and 6, which are schematic diagrams of waveforms of the transmission signals generated by the timing controller TCON. FIGS. 5 and 6 are respectively signal waveforms under voltage and current modes, and the signaling lines CDi_0P, CDi_0N, CDi_1P and CDi_1N accordingly transmit multilevel voltage and current signals. In FIG. 5, the timing controller TCON generates four current levels of {+3al, +al, −al, −3al} during each transmission, where l is unit current intensity, and 'a' is adjustable parameter, and {+} represents a current direction indicating that the timing controller TCON outputs currents via the signaling lines and {−} represents a current direction indicating that the timing controller TCON receives currents from the source drivers. As shown in FIG. 5, the signaling line CDi_1P outputs the 3al current to the source driver CDi during a data symbol period SYM1 and transits to receive the al current to during a data symbol period SYM2, and transits again to output the 3al current during a data symbol period SYM3. From the standpoint of signal matching, during the data symbol period SYM1, the signaling lines CDi_1P and CDi_1N are responsible for the signal pair {+3al, −3al}, whereas the signaling lines CDi_0P and CDi_0N are responsible for the other signal pair {+al, −al}. As can be seen from FIG. 5, the difference of any two neighboring current levels is 2al.

Waveforms in FIG. 6 are the same as those in FIG. 5 and the difference of FIGS. 5 and 6 is that FIG. 6 shows four voltages levels of {+3aV, +aV, −aV, −3aV}, where V is unit voltage, and {+, −} represent two opposite voltage polarities or two voltage polarities according to the common voltage CDi_VCOM. As can be seen from FIG. 6, the difference of any two neighboring voltage levels is 2aV.

In the display, physical channels between the timing controller and the source drivers includes different transmission media, such as package wires, package leads, connectors, flexible printed circuits (FPC), PCB Traces, golden fingers and so forth. Those transmission media could impact the transmission signals and thereby cause channel effects, such as impedance mismatch, coupling and losses. For a large size display, long PCB traces resulting in an increase of the connector number, plus packaging of the timing controller and the source drivers, give rise to stronger channel effects such that the transmission signals are kinked and skewed. Therefore, the source drivers could receive severely distorted signals and thereby degrade the receiving performance.

Please refer to FIGS. 7 and 8. FIG. 7 is a schematic diagram of waveforms of the transmission signal outputted by the timing controller, whereas FIG. 8 is a schematic diagram of waveforms of the transmission signal received by the source driver according to FIG. 7. Transitions of the transmission signals in FIG. 7 are the same as those of the transmission signals in FIG. 5. In FIGS. 7 and 8, the signaling lines CDi_0P, CDi_0N, CDi_1P and CDi_1N are represented by A, D, B and C, respectively. The source driver receives signal pairs of BC and AD according to current thresholds Ith1 and Ith2. Tt1, Tr1, Tt4 and Tr4 are time points where current difference of the AD signal pair becomes greater than the current threshold Ith2 after a waveform crossing appears in the AD signal pair. Tt2, Tr2, Tt3 and Tr3 are time points where current difference of the BC signal pair becomes greater than the current threshold Ith1 after a waveform crossing appears in the BC signal pair. Valid data durations width_t1 and width_r1 are equal to (Tt3-Tt2) and (Tr3-Tr2), respectively. Skew amounts Skew_t1, Skew_t2, Skew_r1 and Skew_r2 are equal to (Tt2-Tt1), (Tt4-Tt3), (Tr2-Tr1) and (Tr4-Tr3), respectively. From comparison of FIGS. 7 and 8, the skew amounts Skew_r1 and Skew_r1 are respectively greater than the skew amounts Skew_t1 and Skew_t2, and the valid data durations width_t1 is shorter than width_r1. Thus, the kink effect results in greater skew amounts and shorter valid data durations after the transmission signal passes through the transmission channels.

Please refer to FIG. 9, which is a schematic diagram of waveforms of another transmission signals received by the source driver. Transitions of the transmission signals in FIG. 9 are different from those of the transmission signals in FIG. 7. Considering the signal line B, current transitions during the data symbol periods SYM4 to SYM6 are {+3al}, {+3al} and {+al}. The source driver receives the signal pair AD according to the current threshold Ith2 and receives the signal pair BC according to the current thresholds Ith3 and Ith4. Current difference of the signal pair AD becomes greater than current threshold Ith2 at a time point Tr5 after a waveform crossing appears in the signal pair AD; Tr6 is a time point where current differences of the signal pairs BA and DC respectively become greater than current threshold Ith3 and Ith4 after a waveform crossing appears in the signal pairs BA and DC; Tr7 is a time point where current differences of the signal pairs BA and DC respectively become greater than current threshold Ith3 and Ith4 after a waveform crossing appears once more in the signal pairs BA and DC. A valid data duration width_r3 is equal to (Tr7-Tr6), and a skew amount Skew_r5 is equal to (Tr6-Tr5). As can be seen from the transmission signal in FIG. 9, the channel effect causes kinks resulting in extension of the skew amount.

Therefore, in the prior art, the valid durations for data reception are shortened due to channel effects, thereby resulting in a higher bit error rate.

SUMMARY OF THE INVENTION

The present invention therefore provides a transmission signal generating method and related device that mainly compensate transmission channel effects by means of introducing different signal differences between signal level and signal level into a multilevel transmission signal, so as to mitigate signal distortion.

The present invention discloses a transmission signal generating method for compensating channel effect for a transmitter of a display device. The transmission signal generating method includes using a plurality of signal amplitudes and a first signal direction to generate a plurality of positive levels; using the plurality of signal amplitudes and a second signal direction to generate a plurality of negative levels; and using a plurality of signaling lines for transmission of the plurality of negative levels and the plurality of positive levels. A transmission signal is formed based on the plurality of positive levels and the plurality of negative levels. A first positive level of the plurality of positive levels and a first negative level of the plurality of negative levels both have a minimum signal amplitude of the plurality of signal amplitudes.

The present invention further discloses a transmission signal generating device for compensating channel effect for a display. The transmission signal generating device includes a signal generator and a plurality of signaling lines. The signal generator uses a plurality of signal amplitudes and a first signal direction to generate a plurality of positive levels and uses the plurality of signal amplitudes and a second signal direction to generate a plurality of negative levels. The plurality of signaling lines are coupled to the signal generator and used for achieving transmission of the plurality of negative levels and the plurality of positive levels. A transmission signal is formed based on the plurality of positive levels and the plurality of negative levels. A first positive level of the plurality of positive levels and a first negative level of the plurality of negative levels both have a minimum signal amplitude of the plurality of signal amplitudes.

In the abovementioned disclosures of the present invention, an amplitude difference of the first positive level and the first negative level is greater than an amplitude difference of any two neighboring negative levels of the plurality of negative levels and also greater than an amplitude difference of any two neighboring positive levels of the plurality of positive levels. Alternatively, the amplitude difference of the first positive level and the first negative level is less than the amplitude difference of any two neighboring negative levels of the plurality of negative levels and also less than the amplitude difference of any two neighboring positive levels of the plurality of positive levels.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 18 is a schematic diagram of a truth table according to an embodiment of the present invention.

DETAILED DESCRIPTION

Figure 10:
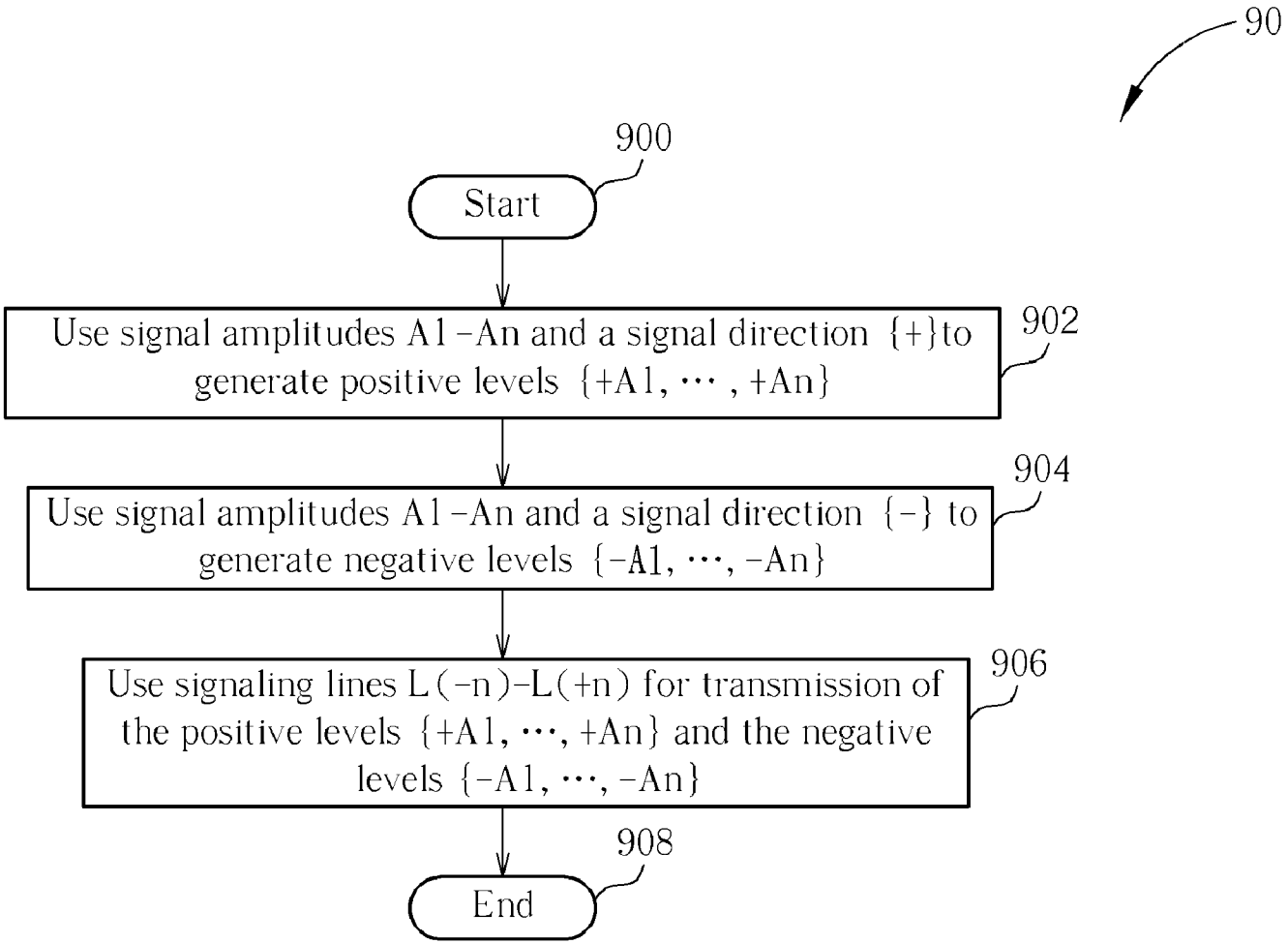
FIG. 10 is a flowchart of a transmission signal generating process according to an embodiment of the present invention.

Please refer to FIG. 10, which is a flowchart of a transmission signal generating process 90 according to an embodiment of the present invention. The transmission signal generating process 90 is applied to a transmitter of a display device for compensating channel effects. The transmission signal generating process 90 includes the following steps:

Step 900: Start.

Step 902: Use signal amplitudes A1-An and a signal direction {+} to generate positive levels {+A1, . . . , +An}.

Step 904: Use signal amplitudes A1-An and a signal direction {−} to generate negative levels {−A1, . . . , −An}.

Step 906: Use signaling lines L(−n)-L(+n) for transmission of the positive levels {+A1, . . . , +An} and the negative levels {−A1, . . . , −An}.

Step 908: End.

Figure 11:
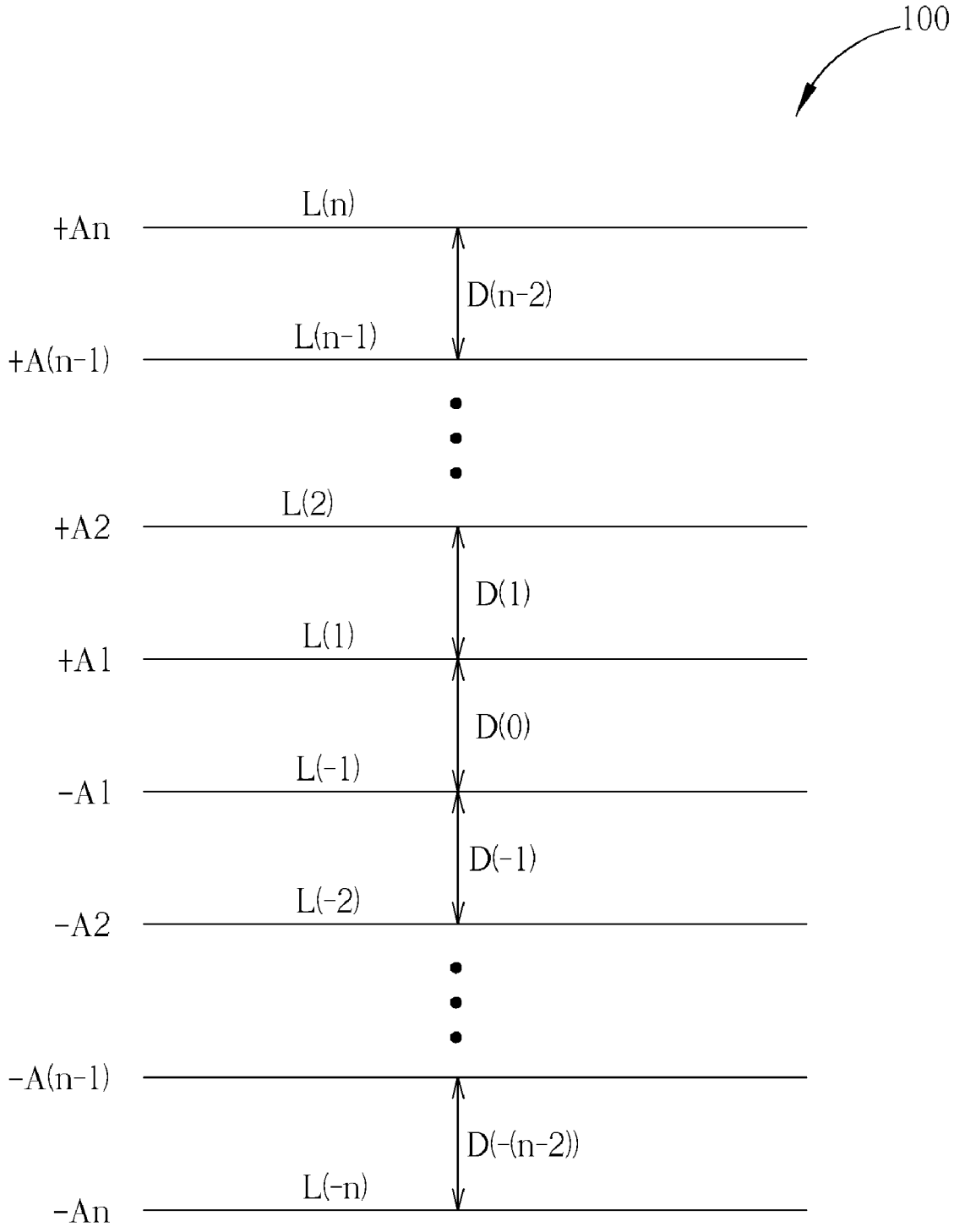
FIG. 11 is a schematic diagram of waveforms of a transmission signal according to an embodiment of the present invention.

In the transmission signal generating process 90, the signal directions {+,−} represent that the transmitter outputs signals and receives signals, respectively. The signal amplitude A1 is the minimum signal amplitude. A signal amplitude difference of the negative level {−A1} and the positive level {+A1} is not equal to level difference of any two neighboring positive or negative levels. Through the transmission signal generating process 90, the positive levels {+A1, . . . , +An} and the negative levels {−A1, . . . , −An} can form a transmission signal 100 as shown in FIG. 11. In the transmission signal 100, the signal lines L(+1)-L(+n) respectively transmit the positive levels {+A1, . . . , +An}, whereas the signal lines L(−1)-L(−n) respectively transmit the negative levels {−A1, . . . , −An}. D(0) is the amplitude difference of the negative level {−A1} and the positive level {+A1}, and D(1) is the amplitude difference of the positive levels {+A1} and {+A2}, and so forth. The amplitude differences D(1)−D(n−2) and D(−1)−D(−(n−2)) are all unequal to D(0).

Preferably, the transmission signal generating process 90 combines a first difference current with the first reference current according to a coding symbol to generate a plurality of forward currents corresponding to the positive levels {+A1, . . . , +An}. Similarly, a second reference current is combined with the second difference current according to the coding symbol to generate a plurality of reverse currents corresponding to the negative levels {−A1, . . . , −An}. Preferably, the second reference and difference currents are identical with the first reference and difference currents, respectively. Furthermore, the signal lines L(+1)-L(+n) are utilized to output the forward currents, whereas the signal lines L(−1)-L(−n) are utilized to receive the reverse currents. From the above, the first difference current is used for realizing the amplitude differences D(1)−D(n−2), and the second difference current is used for realizing the amplitude differences D(−1)−D(−(n−2)).

Please note that, as the amplitude difference D(0) is greater than the amplitude differences D(1)−D(n−2), the first difference current is less than two times of the first reference current. As the amplitude difference D(0) is smaller than the amplitude differences D(1)−D(n−2), the first difference current is larger than two times of the first reference current. In like manner, as the amplitude difference D(0) is greater than the amplitude differences D(−1)−D(−(n−2)), the second difference current is less than two times of the second reference current. As the amplitude difference D(0) is smaller than the amplitude differences D(−1)−D(−(n−2)), the second difference current is larger than two times of the second reference current.

Figure 1:
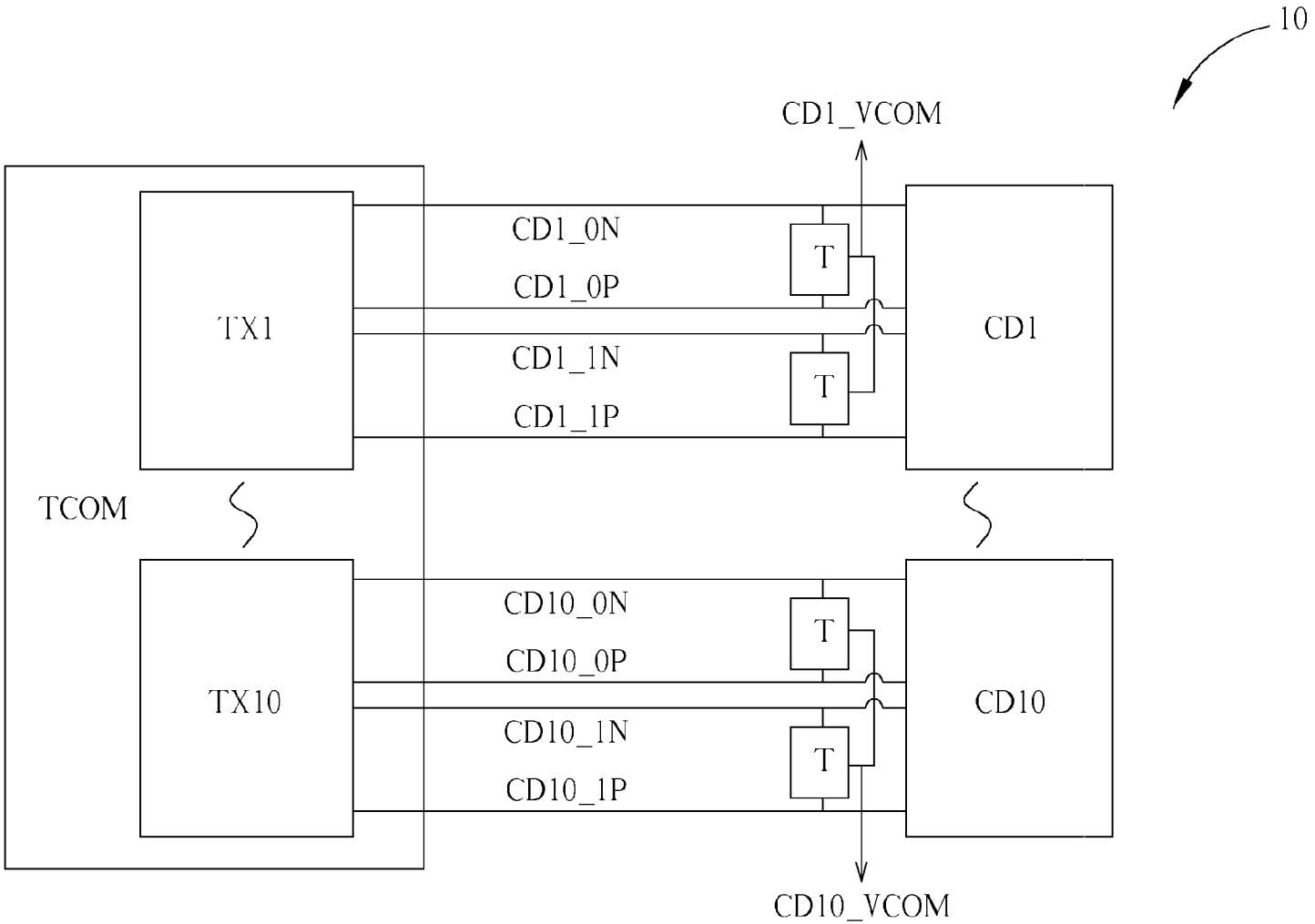
FIG. 1 PRIOR ART
FIG. 1 is a schematic diagram of a driving system according to the prior art.
Figure 2:
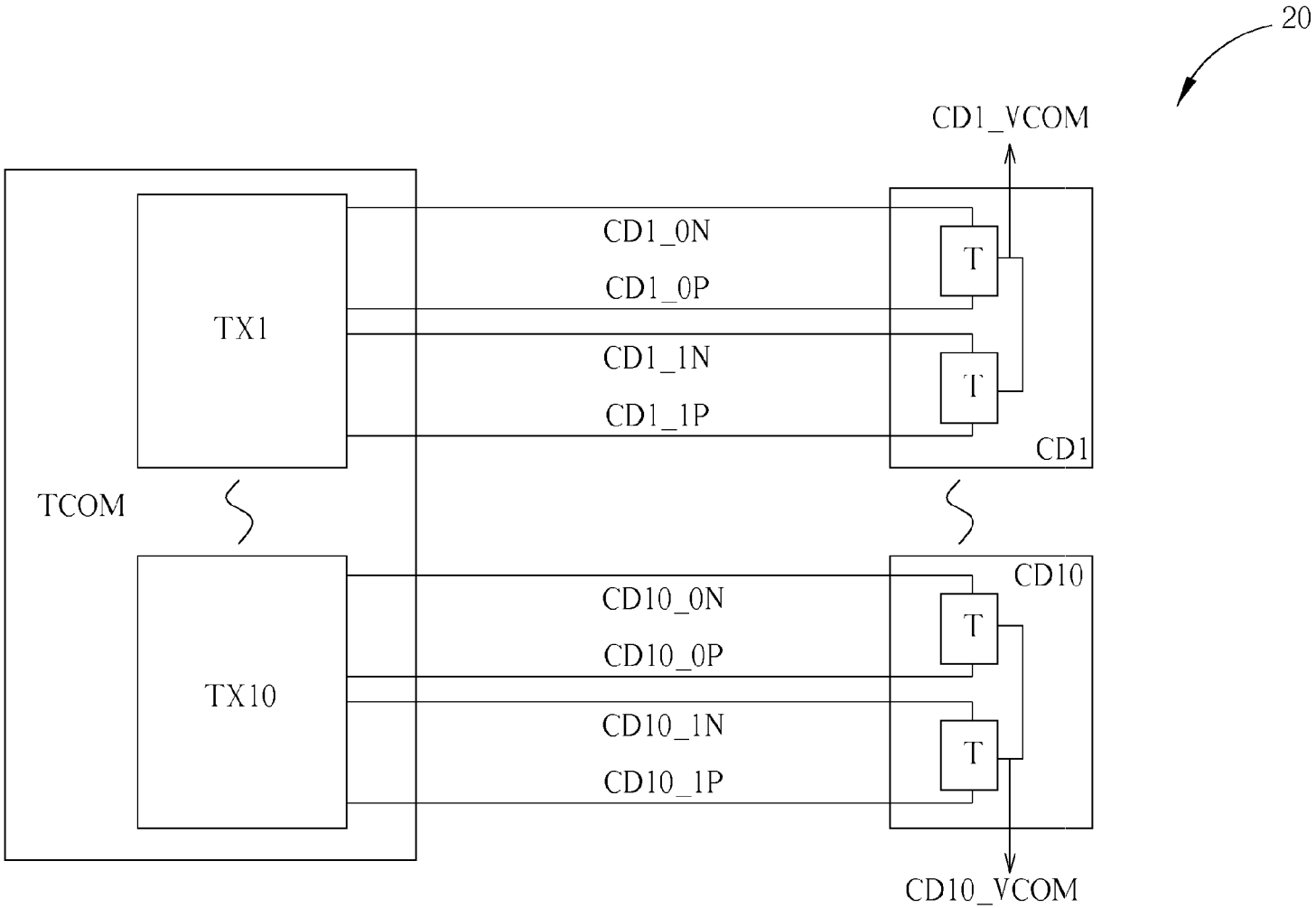
FIG. 2 PRIOR ART
FIG. 2 is a schematic diagram of a driving system according to the prior art.
Figure 3:
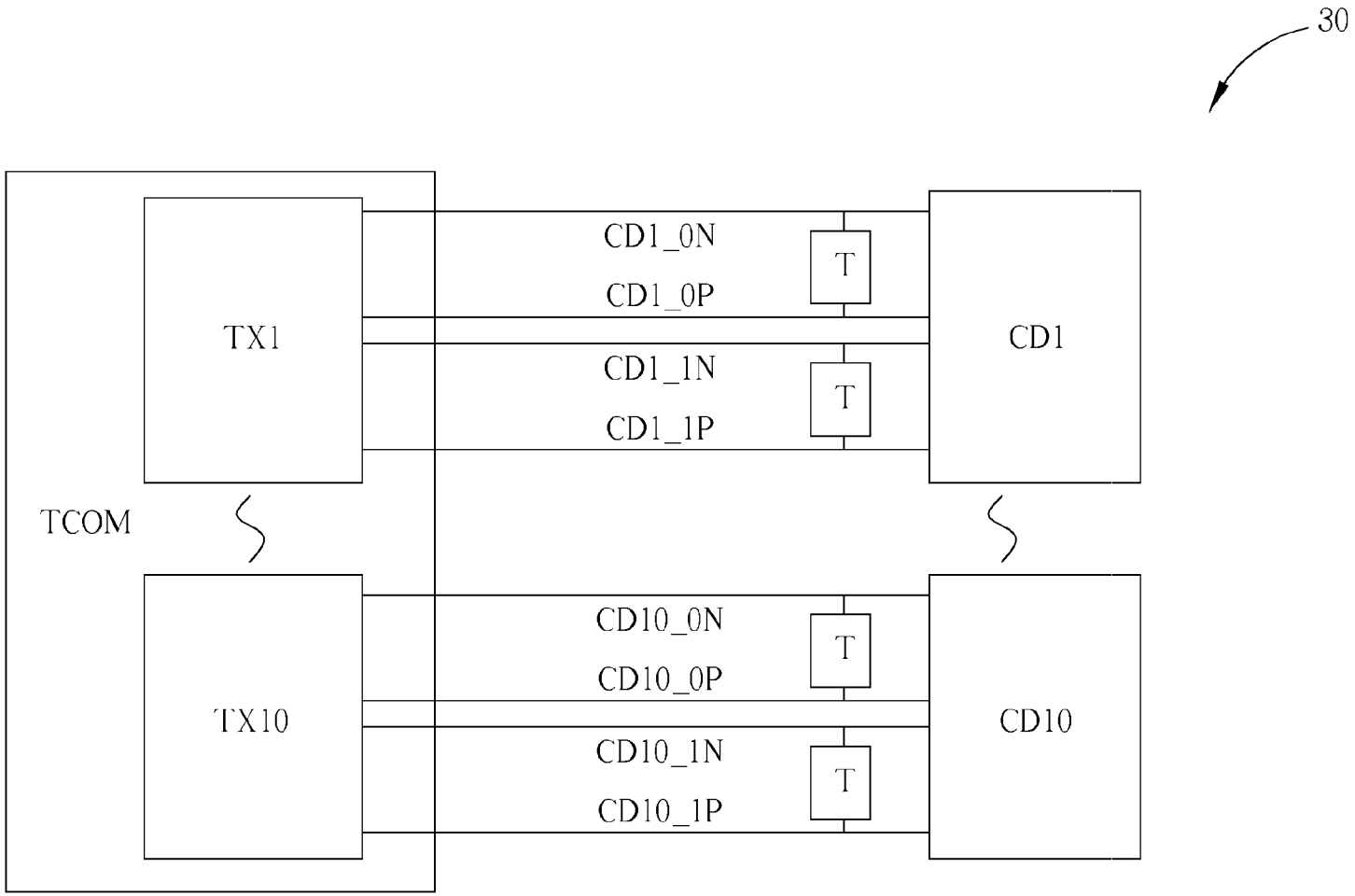
FIG. 3 PRIOR ART
FIG. 3 is a schematic diagram of a driving system according to the prior art.
Figure 4:
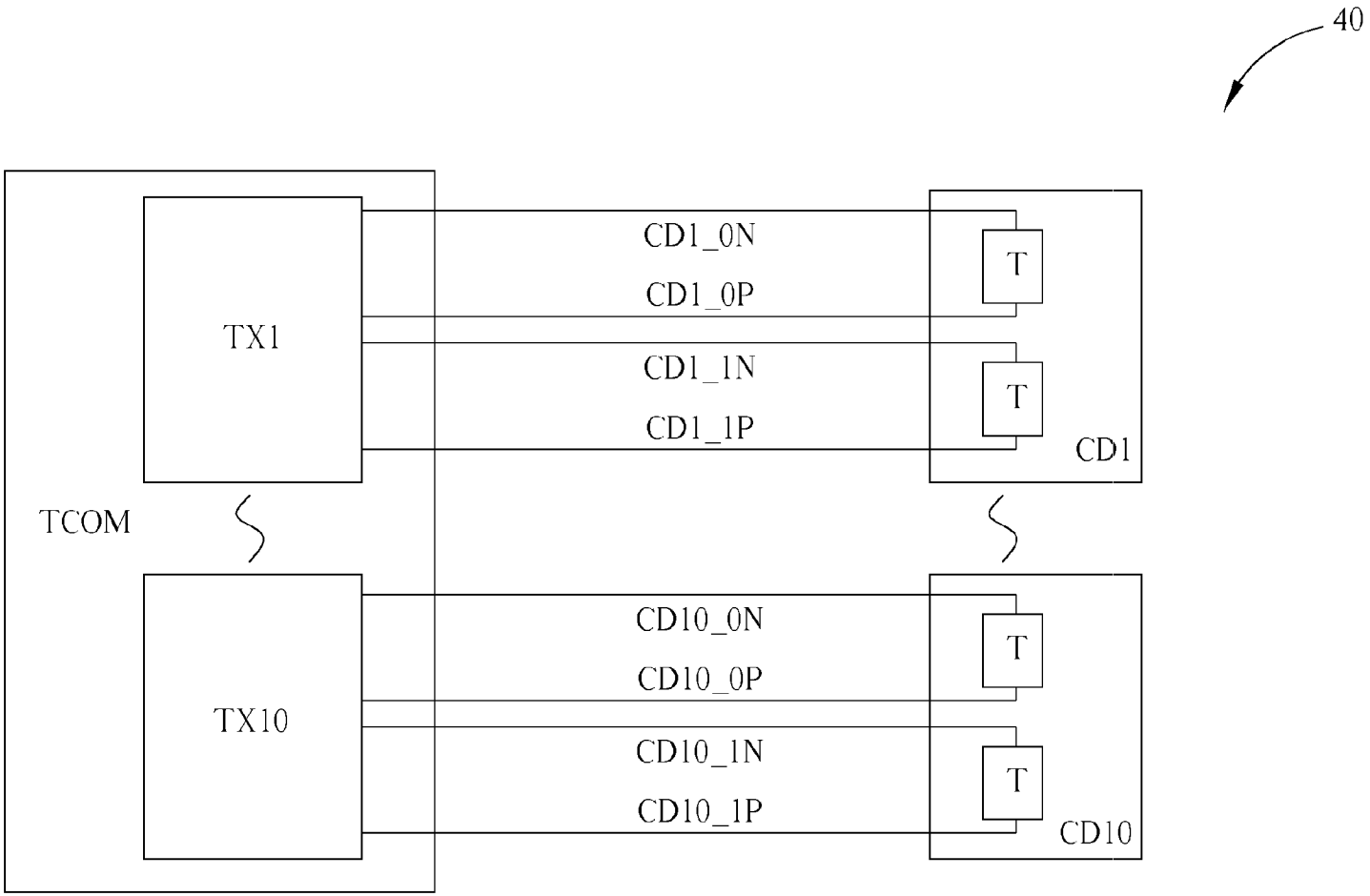
FIG. 4 PRIOR ART
FIG. 4 is a schematic diagram of a driving system according to the prior art.
Figure 5:
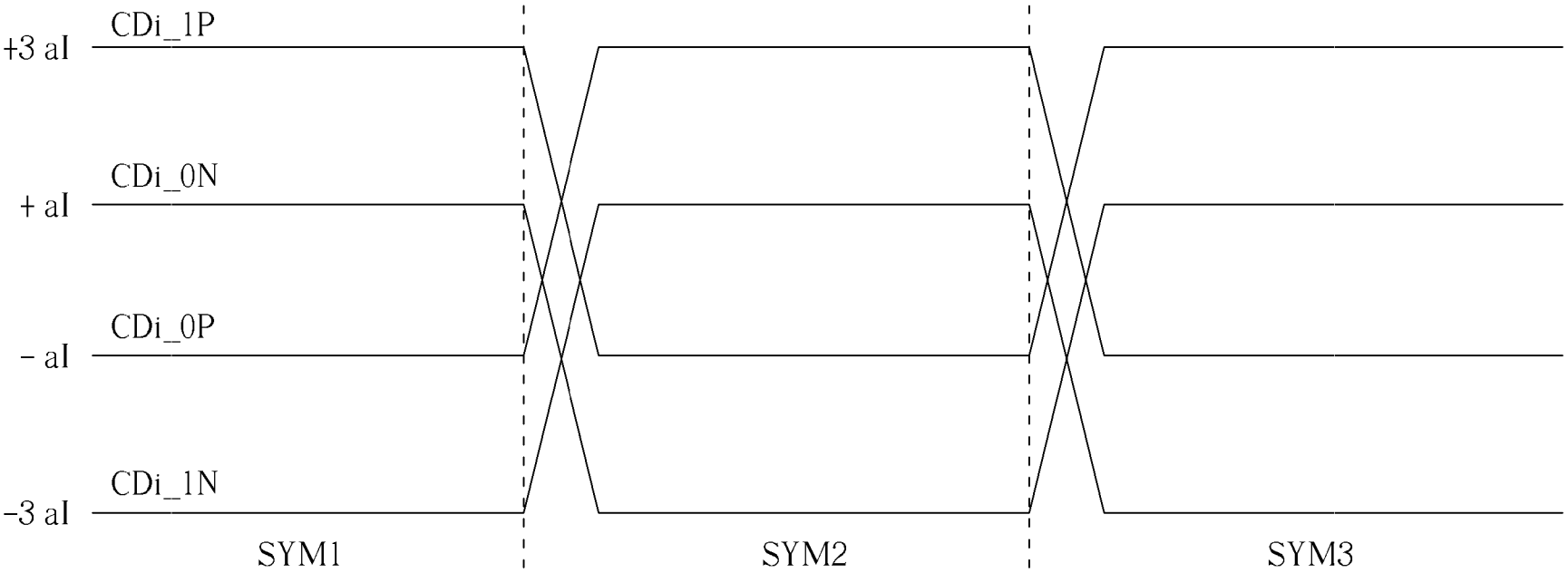
FIG. 5 PRIOR ART
FIG. 5 is a schematic diagram of waveforms of a transmission signal generated by a timing controller according to the prior art.
Figure 6:
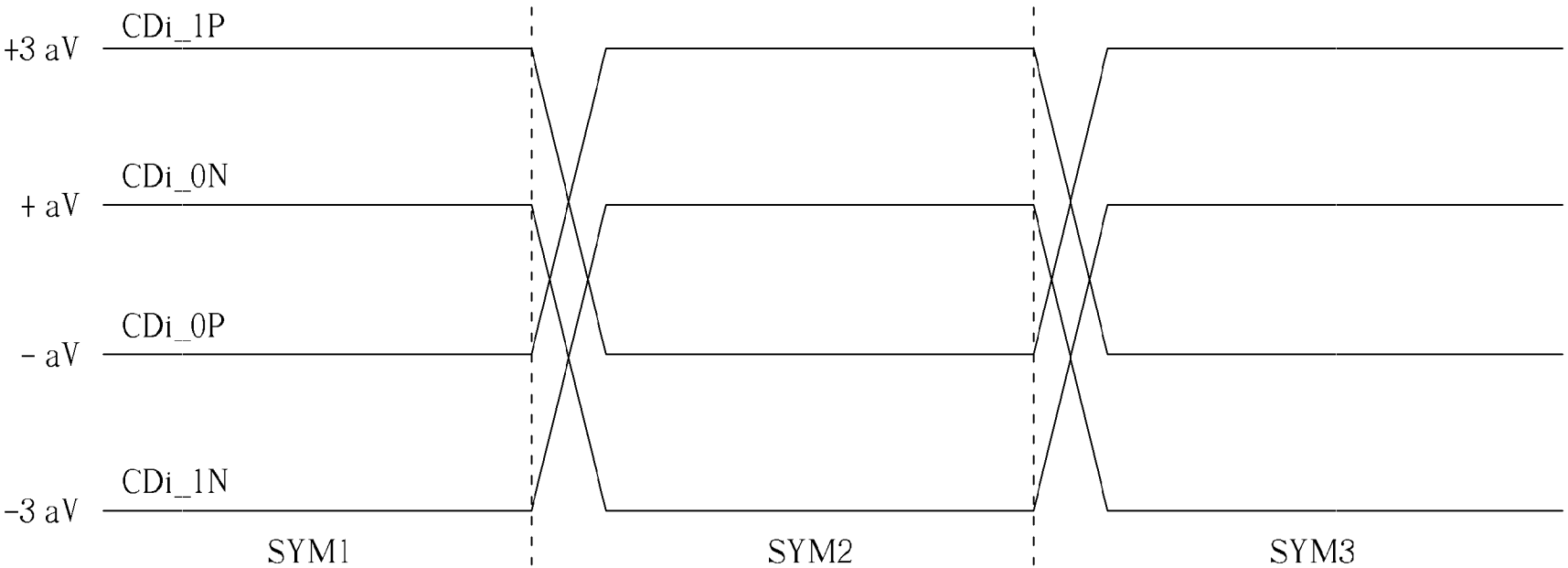
FIG. 6 PRIOR ART
FIG. 6 is a schematic diagram of waveforms of a transmission signal generated by a timing controller according to the prior art.
Figure 7:
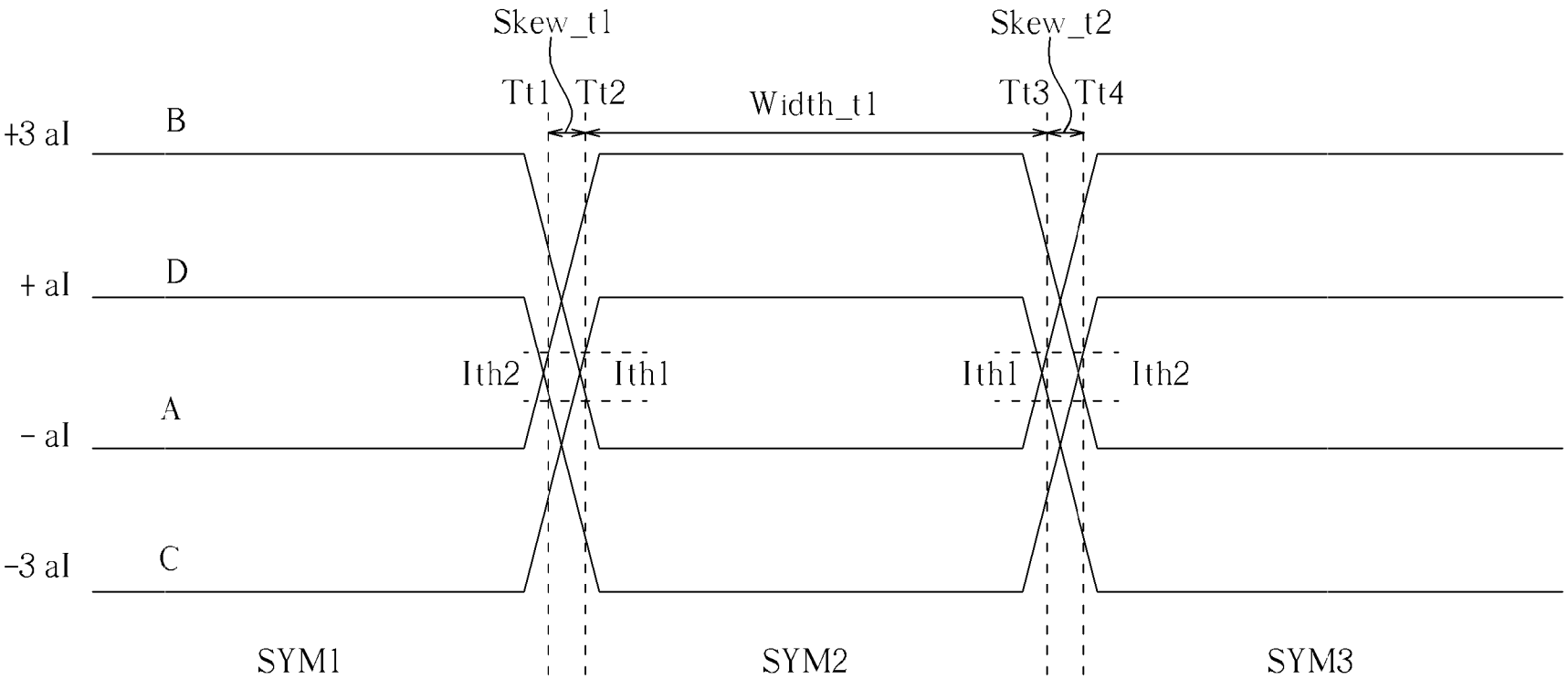
FIG. 7 PRIOR ART
FIG. 7 is a schematic diagram of waveforms of a transmission signal generated by a timing controller according to the prior art.
Figure 12:
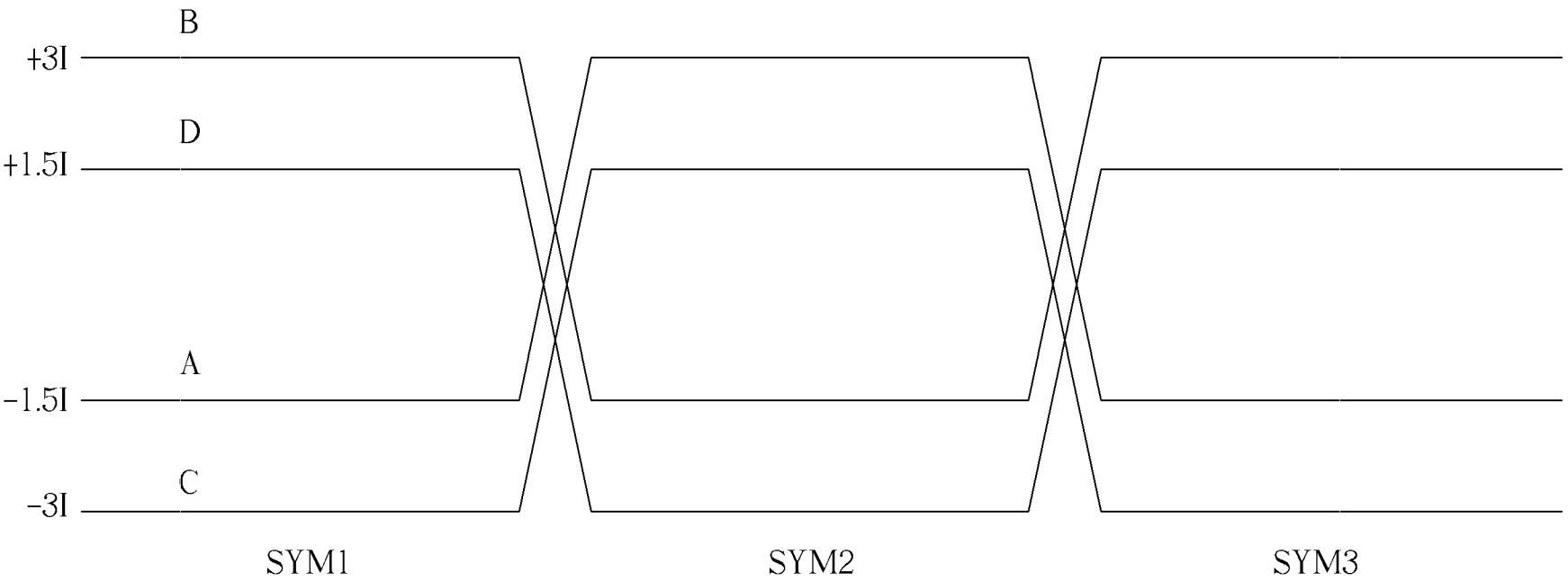
FIG. 12 is a schematic diagram of waveforms of a transmission signal generated by a timing controller according to an embodiment of the present invention.
Figure 13:
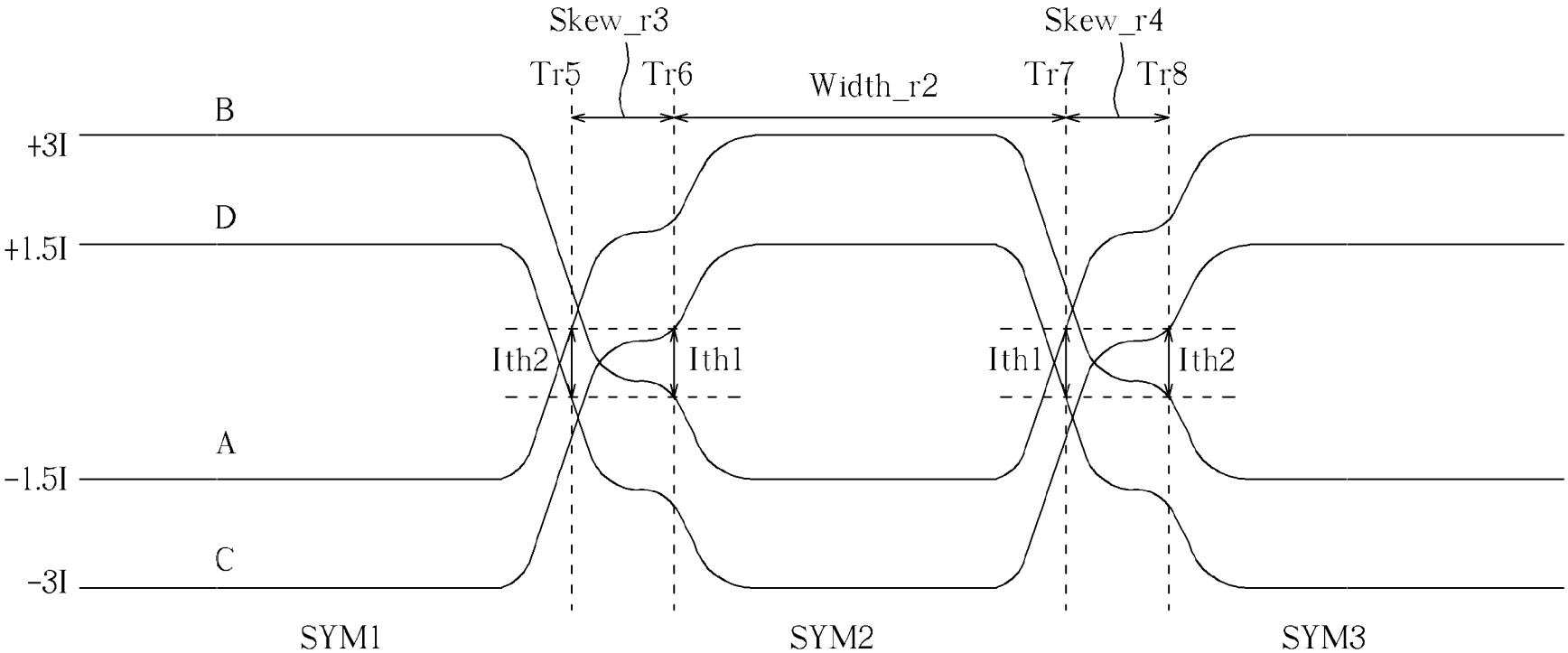
FIG. 13 is a schematic diagram of waveforms of a transmission signal received by a source driver according to an embodiment of the present invention.

The coding symbol is generated from a data symbol including image data and thereby changes with refreshing of the data symbol. According to the change of the coding symbol, each of the signal lines transits to the corresponding signal level. Signal transmission between a timing controller and a source driver in a display is used in the following FIGS. 12-14 for plain explanation for the concept of the present invention. FIG. 12 is a schematic diagram of waveforms of a transmission signal 200 outputted by a timing controller according to an embodiment of the present invention, whereas FIG. 13 is a schematic diagram of waveforms of a transmission signal 300 received by a source driver according to an embodiment of the present invention. The transmission signal 300 is a result of the transmission signal 200 experiencing channel effects. The transmission signal 200 uses the same symbols and symbolizations thereof as the transmission signal in FIG. 7, and has the current levels {+3I, +1.5I, −1.5I, −3I} as well. According to definition used in FIG. 10, the amplitude differences D(0), D(1) and D(−1) of the transmission signal 200 are respectively 3I, 1.5I and 1.5I. A coding symbol is generated based on data content of the data symbol period SYM1, and the signal lines B, D, A and C are respectively responsible for transmission of the current levels {+3I, +1.5I, −1.5I, −3I} according to the coding symbol. At the data symbol period SYM2, the data content is changed, resulting in content change of the coding symbol. Meanwhile, the signal lines B, D, A and C undergo transitions at the beginning of the data symbol period SYM2 and then perform transmission of the current levels {−1.5I, −3I, +3I, +1.5I }, respectively.

Figure 8:
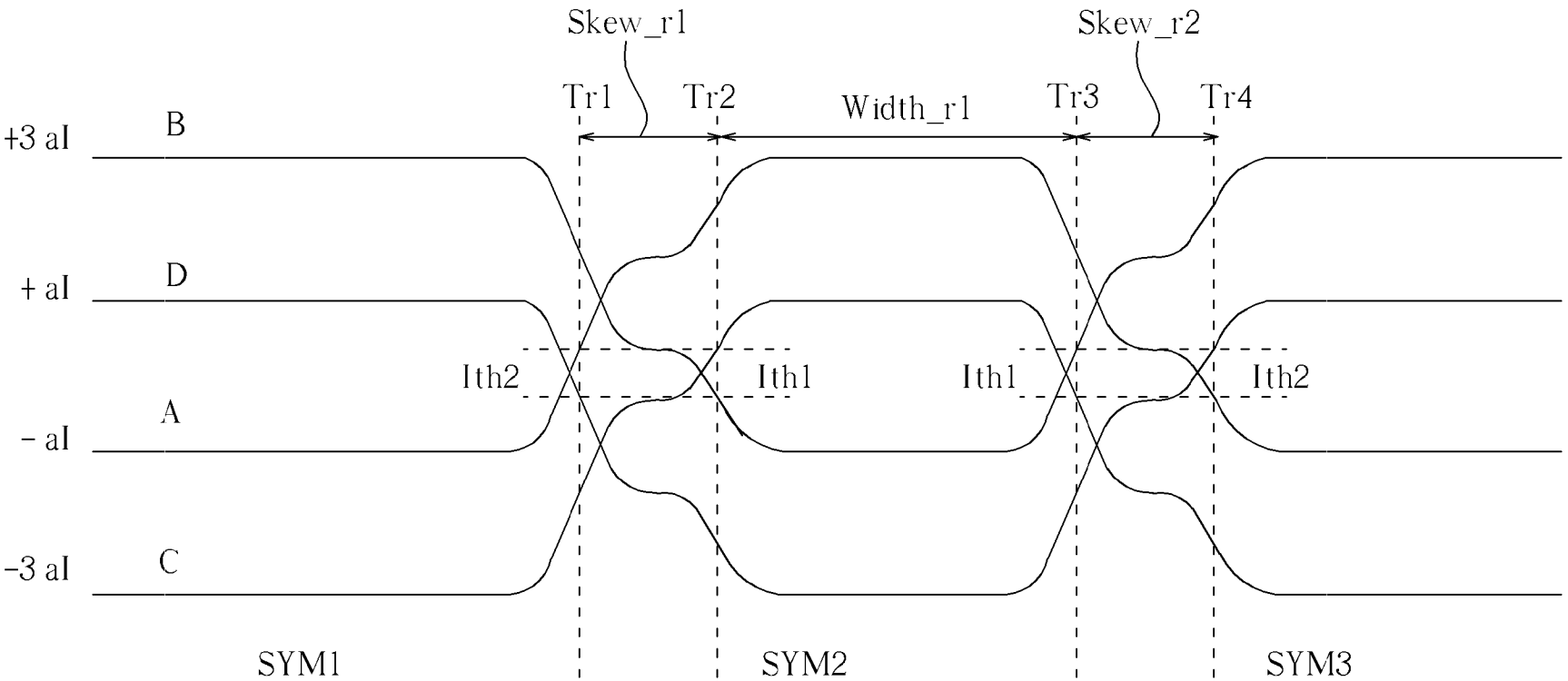
FIG. 8 PRIOR ART
FIG. 8 is a schematic diagram of waveforms of a transmission signal received by a source driver according to the prior art.

Assume the transmission signal 300 in FIG. 13 experiences the same channel environment as the transmission signal in FIG. 8, and FIG. 13 and FIG. 8 use the same symbolizations for the same symbols. In the transmission signal 300, Tr5 and Tr8 are time points where the current difference of the AD signal pair becomes greater than the current threshold Ith2 after a waveform crossing appears in the AD signal pair. Tr6 and Tr7 are time points where the current difference of the BC signal pair becomes greater than the current threshold Ith1 after a waveform crossing appears in the BC signal pair. The valid data duration width_r2, the skew amounts Skew_r3 and Skew_r4 are (Tr7-Tr6), (Tr6-Tr5) and (Tr8-Tr7), respectively. Compared with the transmission signal in FIG. 8, the skew amounts Skew_r3 and Skew_r4 of the transmission signal 300 are both shorter than the skew amounts Skew_r1 and Skew_r2. Furthermore, the valid data duration width_r2 is larger than the valid data duration width_r1. Thus, the transmission signal 300 suffers less distortion resulted from kink effect.

Figure 9:
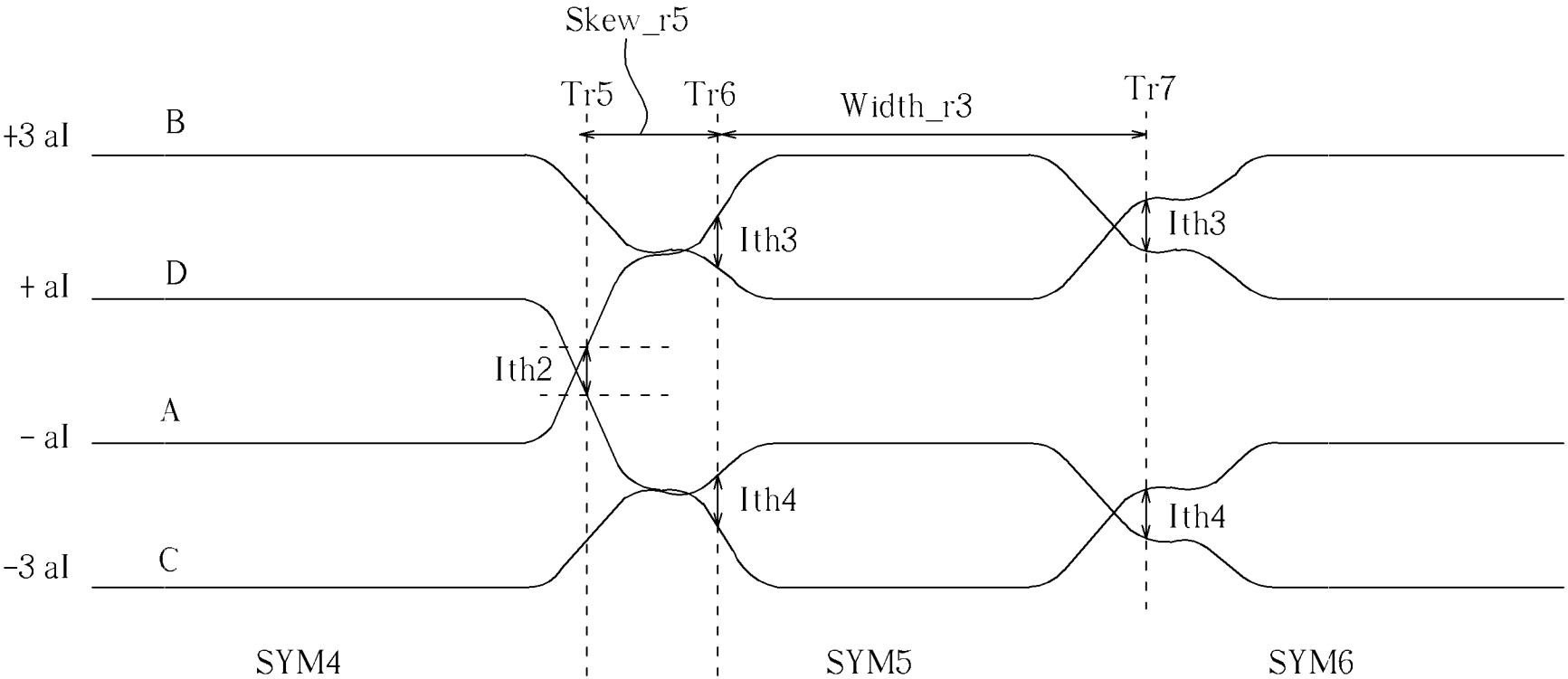
FIG. 9 PRIOR ART
FIG. 9 is a schematic diagram of waveforms of a transmission signal received by a source driver according to the prior art.
Figure 14:
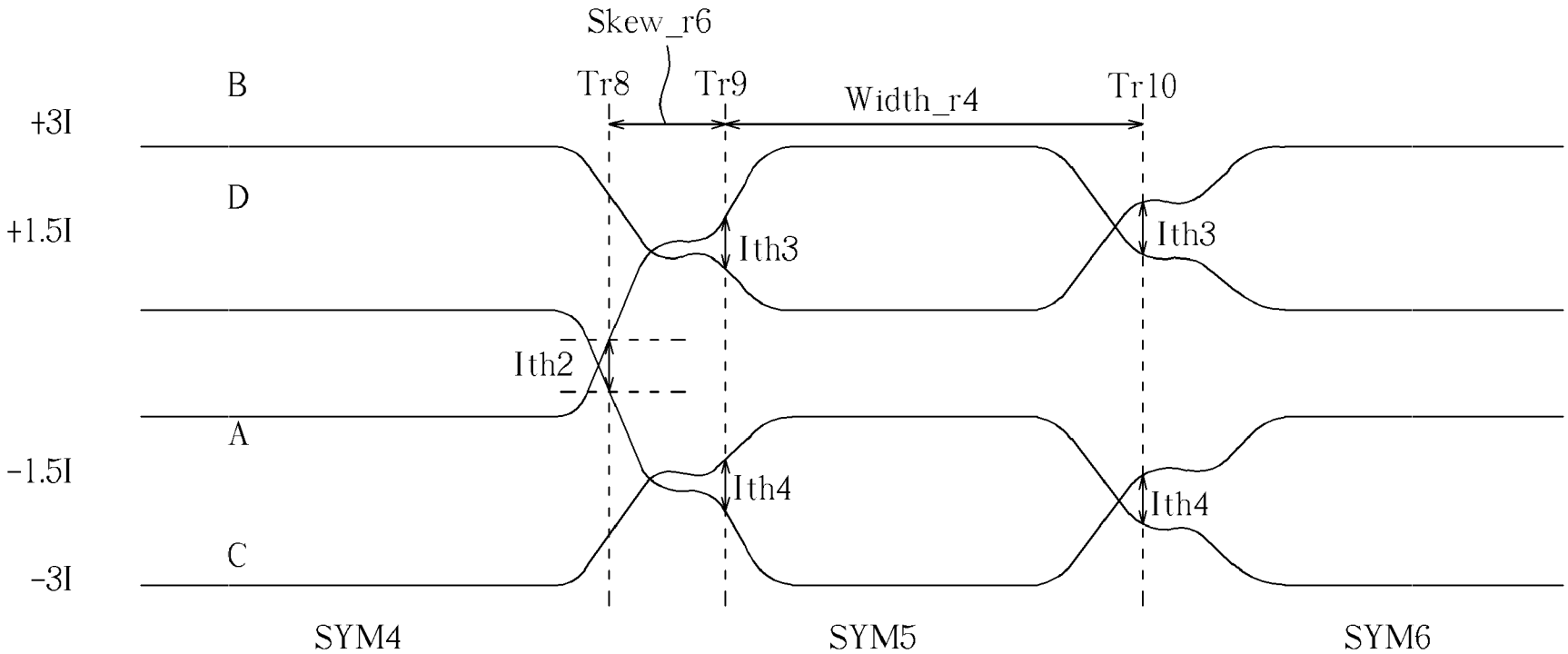
FIG. 14 is a schematic diagram of waveforms of a transmission signal received by a source driver according to an embodiment of the present invention.

Taking another example, the timing controller outputs transmission signal with current levels {+3I, +0.5I, −0.5I, −3I}, and thereby the amplitude differences D(0), D(1) and D(−1) are known as 1I, 2.5I and 2.5I, respectively. FIG. 14 is a schematic diagram of waveforms of a transmission signal 400 received by a source driver according to another embodiment of the present invention. The transmission lines A, B, C, and D used for the transmission signal 400 have the same level transitions as the transmission signal in FIG. 9. Comparing FIG. 14 with FIG. 9, the transmission signal 400 has a skew amount Skew_r6 smaller than the skew amount Skew_r5 in FIG. 9, and a valid data duration width_r4 larger than the valid data duration width_r3 in FIG. 9. Thus, the transmission signal 400 suffers less distortion resulted from kink effect and has larger effective data receiving scope.

Figure 15:
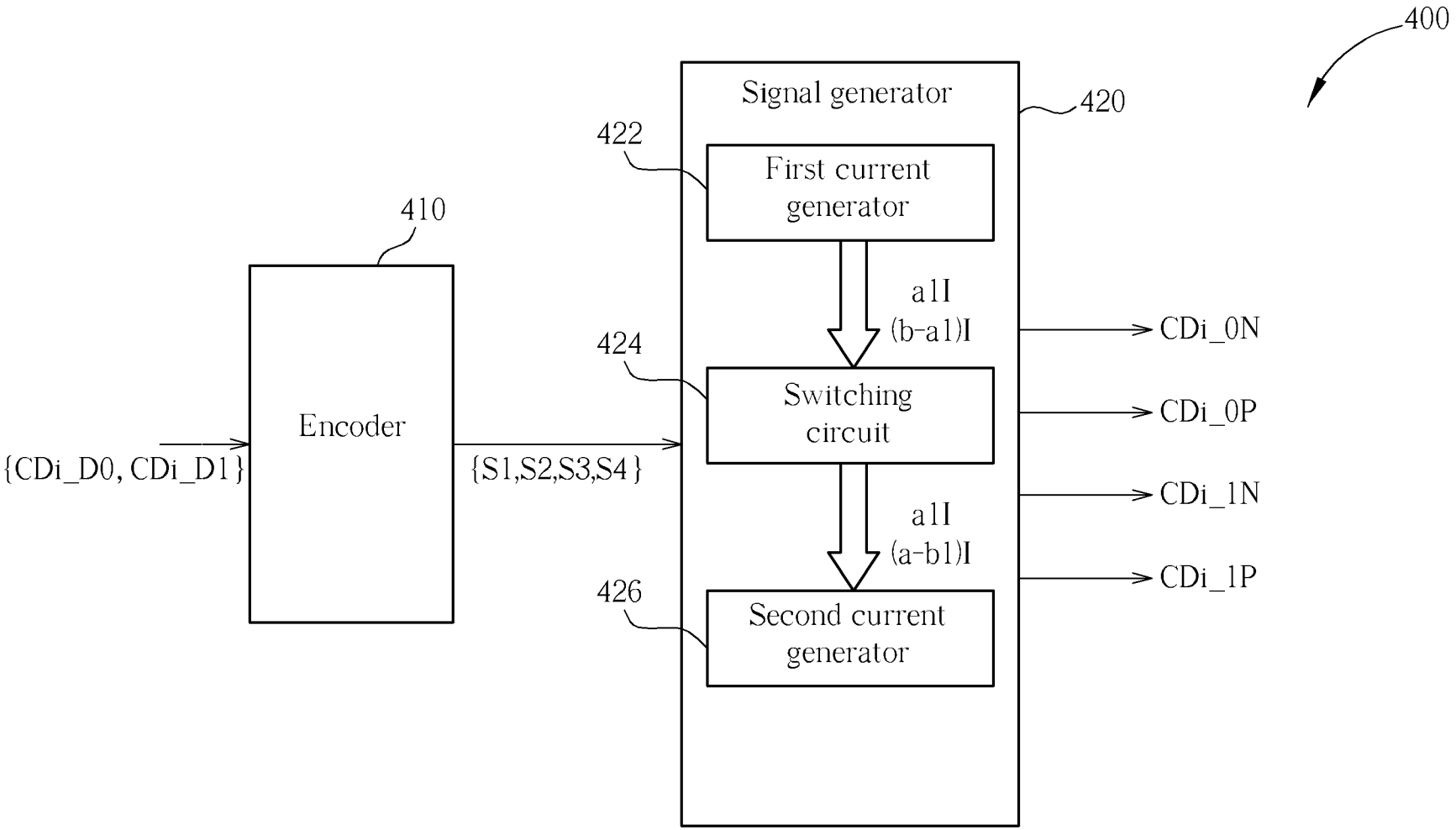
FIG. 15 is a schematic diagram of a transmission signal generating device according to an embodiment of the present invention.

Please refer to FIG. 15, which is a schematic diagram of a transmission signal generating device 400 according to an embodiment of the present invention. Preferably, the transmission signal generating device 400 is installed in a timing controller of a display, and utilized for compensating channel effects which the transmission signal experiences during transmission to the source driver CDi, where i is an assign number to the source drivers. The transmission signal generating device 400 generates the transmission signal with current levels {+bl, +a1*l*, −a1*l*, −bl}, and includes an encoder 410, a signal generator 420 and signal lines CDi_0P, CDi_0N, CDi_1P and CDi_1N, where l is unit current. The encoder 410 generates a coding symbol {S1, S2, S3, S4} according to a data symbol {CDi_D0, CDi_D1}. The signal generator 420 includes a first current generator 422, a switching circuit 424 and a second current generator 426. The first current generator 422 and the second current generator 426 both provide a reference current a1*l* and a difference current (b−a1)l for the switching circuit 424, and the difference current (b−a1)l is larger or less than two times of the reference current a1*l*. The switching circuit 420 combines the reference current a1*l* with the difference current (b−a1)l according to the code words S1-S4, so as to generate currents with intensities bl and a1*l*. Any two of the signal lines CDi_0P, CDi_0N, CDi_1P and CDi_1N are used for outputting the currents, as can be considered current levels +bl and +a1*l*; the other two signal lines are used for receiving the currents flowing back from the source driver CDi, as can be considered current levels −bl and −a1*l*.

Figure 16:
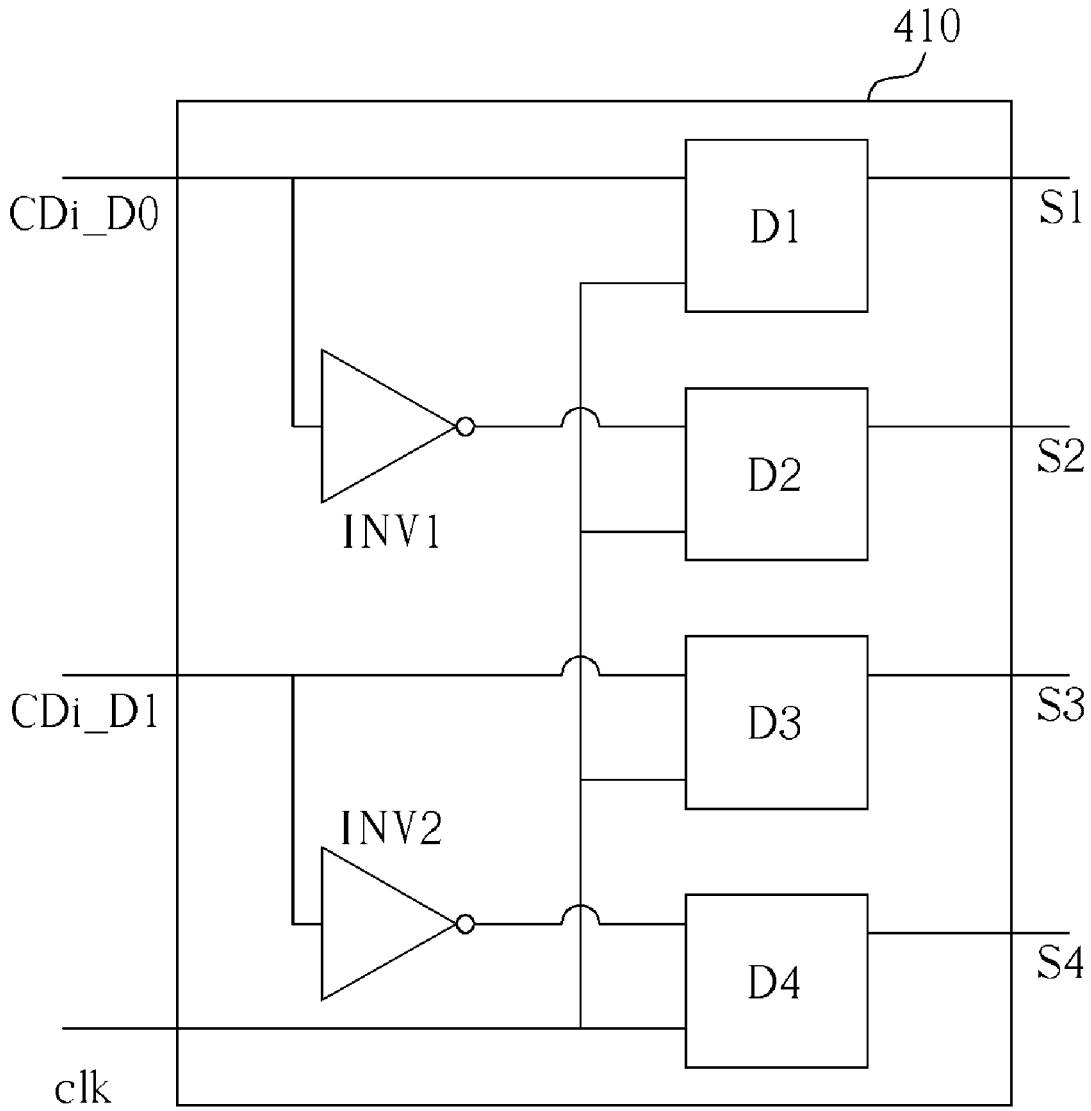
FIG. 16 is a schematic diagram of the encoder according to a preferred embodiment of the present invention.
Figure 17:
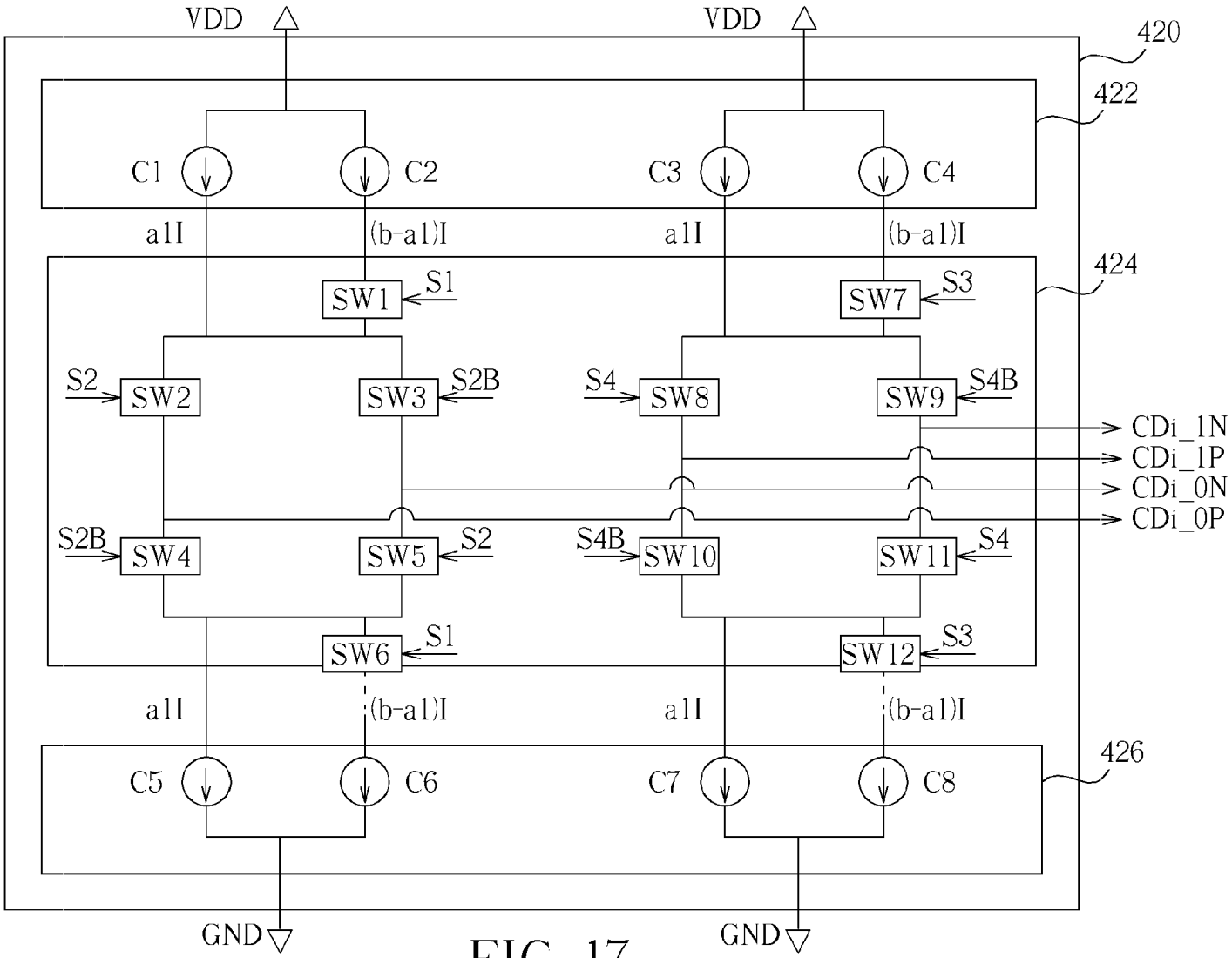
FIG. 17 is a schematic diagram of the signal generator according to a preferred embodiment of the present invention.

Please refer to FIG. 16, which is a schematic diagram of the encoder 410 according to a preferred embodiment of the present invention. The encoder 410 includes delay circuits D1-D4 and inverters INV1 and INV2, wherein clk is a clock signal. Please refer to FIG. 17, which is a schematic diagram of the signal generator 420 according to a preferred embodiment of the present invention. In the signal generator 420, a first current generator 422 includes current sources C1-C4 coupled to a power supplying terminal VDD. The current sources C1 and C3 provide the reference current a1*l*, whereas the current sources C2 and C4 provide the difference current (b−a1)l. Similarly, a second current generator 426 includes the current sources C5-C8 coupled to a grounding terminal GND. The current sources C5 and C7 provide the reference current a1*l*, whereas the current sources C6 and C8 provide the difference current (b−a1)l. The switching circuit 424 includes switches SW1-SW12 for controlling connections according to corresponding code words {S1, S2, S2B, S3, S4, S4B} to achieve combination of the reference current a1*l* and the difference current (b−a1)l. S2B and S4B are inverted bits of S2 and S4, respectively. The signal lines CDi_0P, CDi_0N, CDi_1P and CDi_1N are responsible for transmission of the combined currents.

Please refer to FIG. 18, which is a schematic diagram of a truth table 500 according to an embodiment of the present invention. The truth table 500 records a logic relationship between the data symbol {CDi_D0, CDi_D1} and the coding symbol {S1, S2, S3, S4}, and corresponding current levels for the signal lines CDi_0P, CDi_0N, CDi_1P and CDi_1N. For example, the encoder 410 generates a coding symbol {0, 0, 1, 1} as the data symbol is inputted with {0, 0}, and thereby the code words {S1, S2, S2B, S3, S4, S4B} are {0, 0, 1, 1, 1, 0} derived from the coding symbol. With control of the code words, the switches SW3, SW4, SW7, SW8, SW11 and SW12 of the switching circuit 424 conduct the connections, and the rest of the switches cut off the connections. In this situation, the signal line CDi_0P outputs the current level {−a1*l*} provided by the current sources C5; the signal lines CDi_0N outputs the current level {+a1*l*} provided by the current sources C1; the signal lines CDi_1P outputs the current level {+bl} combined by the current sources C3 and C4; the signal lines CDi_1N outputs the current level {−bl} combined by the current sources C7 and C8. Other patterns in the truth table 500 can be realized by a similar manner to the above mentions.

In summary, the embodiments of the present invention introduce unequal level differences into the transmission signal in order to suppress kink effect, and thereby the valid data receiving duration can be maintained at a reasonable length. The present invention can significantly compensate channel effects for the transmission signal so as to improve receiving performance of the source drivers.

Those skilled in the art will readily observe that numerous modifications and alterations of the device and method may be made while retaining the teachings of the invention.

What is claimed is:

1. A transmission signal generating method for compensating channel effect for a transmitter of a display device, the transmission signal generating method comprising:

providing at least a first reference current and at least a first difference current, the first difference current being less than two times of the first reference current;

providing at least a second reference current and at least a second difference current, the second reference current being equal to the first reference current, the second difference current being equal to the first difference current;

combining the first reference current with the first difference current according to a coding symbol to generate a plurality of forward currents corresponding to a plurality of positive levels;

combining the second reference current with the second difference current according to the coding symbol to generate a plurality of reverse currents corresponding to a plurality of negative levels; and using a plurality of signaling lines for transmission of the plurality of negative levels and the plurality of positive levels;

wherein a transmission signal is formed based on the plurality of positive levels and the plurality of negative levels, and a first positive level of the plurality of positive levels and a first negative level of the plurality of negative levels both have a minimum signal amplitude of the plurality of signal amplitudes, and an amplitude difference of the first positive level and the first negative level is greater than an amplitude difference of any two neighboring negative levels of the plurality of negative levels and also greater than an amplitude difference of any two neighboring positive levels of the plurality of positive levels.

2. The transmission signal generating method of claim 1, wherein using the plurality of signaling lines for the transmission of the pluralities of negative and positive levels comprises using the plurality of signaling lines for forwarding the plurality of positive levels and receiving the plurality of negative levels.

3. The transmission signal generating method of claim 1 further comprising generating the coding symbol according to a data symbol.

4. The transmission signal generating method of claim 1, wherein the transmission signal is a voltage signal or a current signal.

5. A transmission signal generating device for compensating channel effect for a display, the transmission signal generating device comprising:

a signal generator for using a plurality of signal amplitudes and a first signal direction to generate a plurality of positive levels and using the plurality of signal amplitudes and a second signal direction to generate a plurality of negative levels, the signal generator comprising:

a first current generator comprising a plurality of current sources coupled to a power supplying terminal, for providing at least a first reference current and at least a first difference current, the first difference current being less than two times of the first reference current;

a second current generator comprising a plurality of current sources coupled to a grounding terminal, for providing at least a second reference current and at least a second difference current, the second reference current being equal to the first reference current, the second difference current being equal to the first difference current; and a switching circuit coupled to the first current generator and the second current generator, for combining the first reference current with the first difference current according to a coding symbol to generate a plurality of forward currents corresponding to the plurality of positive levels and combining the second reference current with the second difference current according to the coding symbol to generate a plurality of reverse currents corresponding to the plurality of negative levels; and a plurality of signaling lines coupled to the signal generator, for achieving transmission of the plurality of negative levels and the plurality of positive levels;

wherein a transmission signal is formed based on the plurality of positive levels and the plurality of negative levels, and a first positive level of the plurality of positive levels and a first negative level of the plurality of negative levels both have a minimum signal amplitude of the plurality of signal amplitudes, and an amplitude difference of the first positive level and the first negative level is greater than an amplitude difference of any two neighboring negative levels of the plurality of negative levels and also greater than an amplitude difference of any two neighboring positive levels of the plurality of positive levels.

6. The transmission signal generating device of claim 5, wherein the plurality of signaling lines forwards the plurality of positive levels and receives the plurality of negative levels.

7. The transmission signal generating device of claim 5 further comprising an encoder coupled to the signal generator, for generating the coding symbol according to a data symbol.

8. The transmission signal generating device of claim 5, wherein the transmission signal is a voltage signal or a current signal.

9. The transmission signal generating device of claim 5 being installed in a timing controller of the display.

10. A transmission signal generating method for compensating channel effect for a transmitter of a display device, the transmission signal generating method comprising:

providing at least a first reference current and at least a first difference current, the first difference current being greater than two times of the first reference current;

providing at least a second reference current and at least a second difference current, the second reference current being equal to the first reference current, the second difference current being equal to the first difference current;

combining the first reference current with the first difference current according to a coding symbol to generate a plurality of forward currents corresponding to a plurality of positive levels;

combining the second reference current with the second difference current according to the coding symbol to generate a plurality of reverse currents corresponding to a plurality of negative levels; and using a plurality of signaling lines for transmission of the plurality of negative levels and the plurality of positive levels;

wherein a transmission signal is formed based on the plurality of positive levels and the plurality of negative levels, and a first positive level of the plurality of positive levels and a first negative level of the plurality of negative levels both have a minimum signal amplitude of the plurality of signal amplitudes, and an amplitude difference of the first positive level and the first negative level is less than an amplitude difference of any two neighboring negative levels of the plurality of negative levels and also less than an amplitude difference of any two neighboring positive levels of the plurality of positive levels.

11. The transmission signal generating method of claim 10, wherein using the plurality of signaling lines for the transmission of the pluralities of negative and positive levels comprises using the plurality of signaling lines for forwarding the plurality of positive levels and receiving the plurality of negative levels.

12. The transmission signal generating method of claim 10 further comprising generating the coding symbol according to a data symbol.

13. The transmission signal generating method of claim 10, wherein the transmission signal is a voltage signal or a current signal.

14. A transmission signal generating device for compensating channel effect for a display, the transmission signal generating device comprising:

a signal generator for using a plurality of signal amplitudes and a first signal direction to generate a plurality of positive levels and using the plurality of signal amplitudes and a second signal direction to generate a plurality of negative levels, the signal generator comprising:

a first current generator comprising a plurality of current sources coupled to a power supplying terminal, for providing at least a first reference current and at least a first difference current, the first difference current being greater than two times of the first reference current;

a second current generator comprising a plurality of current sources coupled to a grounding terminal, for providing at least a second reference current and at least a second difference current, the second reference current being equal to the first reference current, the second difference current being equal to the first difference current; and a switching circuit coupled to the first current generator and the second current generator, for combining the first reference current with the first difference current according to a coding symbol to generate a plurality of forward currents corresponding to the plurality of positive levels and combining the second reference current with the second difference current according to the coding symbol to generate a plurality of reverse currents corresponding to the plurality of negative levels; and a plurality of signaling lines coupled to the signal generator, for achieving transmission of the plurality of negative levels and the plurality of positive levels;

wherein a transmission signal is formed based on the plurality of positive levels and the plurality of negative levels, and a first positive level of the plurality of positive levels and a first negative level of the plurality of negative levels both have a minimum signal amplitude of the plurality of signal amplitudes, and an amplitude difference of the first positive level and the first negative level is less than an amplitude difference of any two neighboring negative levels of the plurality of negative levels and also less than an amplitude difference of any two neighboring positive levels of the plurality of positive levels.

15. The transmission signal generating device of claim 14, wherein the plurality of signaling lines forwards the plurality of positive levels and receives the plurality of negative levels.

16. The transmission signal generating device of claim 14 further comprising an encoder coupled to the signal generator, for generating the coding symbol according to a data symbol.

17. The transmission signal generating device of claim 14, wherein the transmission signal is a voltage signal or a current signal.

18. The transmission signal generating device of claim 14 being installed in a timing controller of the display.

* * * * *